United States Patent [19]

Jost et al.

[11] Patent Number: 4,880,558

[45] Date of Patent: Nov. 14, 1989

[54] LIQUID CLEANING PREPARATION FOR HARD SURFACES

[75] Inventors: Frantisek Jost, Duesseldorf; Klaus-Dieter Wisotzki, Erkrath, both of Fed. Rep. of Germany

[73] Assignee: Henkel Kommanditgesellschaft auf Aktien, Duesseldorf, Fed. Rep. of Germany

[21] Appl. No.: 209,154

[22] Filed: Jun. 20, 1988

[30] Foreign Application Priority Data

Jun. 19, 1987 [DE] Fed. Rep. of Germany ..... 3720262

[51] Int. Cl.[4] ..... C11D 3/37

[52] U.S. Cl. ..... 252/174.23; 257/173; 257/540; 257/535; 257/554; 257/559

[58] Field of Search ..... 252/174.23, 173, 535, 252/540, 554, 559

[56] References Cited

U.S. PATENT DOCUMENTS 4,175,062 11/1979 Disch et al. ..... 252/540

*Primary Examiner*—Paul Lieberman
*Assistant Examiner*—John F. McNally
*Attorney, Agent, or Firm*—Ernest G. Szoke; Wayne C. Jaeschke; Henry E. Millson, Jr.

[57] ABSTRACT

Liquid cleaning preparations for hard surfaces containing (a) 0.5 to 40% by weight, preferably 5 to 20% by weight, of a surfactant or a surfactant mixture;

(b) 0.01 to 1% by weight, preferably 0.05 to 0.5% by weight, of cleaning enhancer;

(c) 0 to 6% by weight, preferably 1.0 to 6% by weight, of at least one organic and/or inorganic builder;

and up to a total of 100% by weight, based on the total weight, of water, and optionally, one or more of solubilizers (solvents, hydrotropes), preservatives, antimicrobial agents, viscosity regulators, pH regulators, perfumes, and dyes. Component (b) is a mixture of (i) at least one polyacrylamide and (ii) at least one highly polyethoxylated monofunctional or polyfunctional alkanol.

29 Claims, No Drawings

LIQUID CLEANING PREPARATION FOR HARD SURFACES

BACKGROUND OF THE INVENTION

1. Field of the Invention

This invention relates to liquid cleaning preparations.

2. Statement of Related Art

British Patent 800,705 discloses liquid cleaning preparations which are used for all purposes, but more especially for washing fabrics, and which, in addition to anionic and nonionic surfactants, contain, inter alia, small quantities of water-soluble cellulose or starch derivatives or water-soluble or collodially soluble polymers, such as polyvinylpyrrolidone, to increase soil suspending power.

U.S. Pat. No. 3,380,925 discloses liquid cleaning preparations which may also contain water-soluble substances of high molecular weight as soil suspending agents. Water-soluble salts of polyacrylic acid and water-soluble derivatives of cellulose, such as carboxymethyl cellulose, are mentioned as examples. In this case, too, mixtures of anionic and nonionic surfactants are preferably used.

U.S. Pat. No. 3,591,509 discloses liquid all-purpose cleaning preparations which, in addition to water-soluble, synthetic surfactants, organic solvents and, optionally, water-soluble builders, contain a small quantity of a special water-soluble carboxymethyl cellulose, namely one having a degree of substitution of from about 1 to about 2 and a degree of polymerization of from about 1,000 to 3,000, and also water. This product has a thickening effect and is intended to improve the adhesion of the cleaning preparations to the soiled surfaces.

U.S. Pat. No. 3,970,594 discloses liquid builder-containing cleaning preparations for hard surfaces containing small quantities of preferably anionic surfactants in combination with small quantities of a mixture of polyvinyl alcohol and/or polyvinylpyrrolidone and polysaccharide salt, which are also said to show improved soil removing power.

U.S. Pat. No. 4,175,062 describes liquid cleaning preparations for hard surfaces which consist essentially of a mixture of anionic and nonionic surfactants and, optionally, other standard constituents of such preparations, such as for example builders, adducts of ethylene oxide with aliphatic vicinal diols or partially etherified diols having a linear $C_{10}$-$C_{20}$ alkyl chain used as the nonionic surfactants. These cleaning preparations may also contain additions of water-soluble high molecular weight substances, such as polyvinyl alcohol, polyvinylpyrrolidone and carboxymethyl cellulose, to enhance their cleaning effect.

None of the polymeric cleaning enhancers mentioned above satisfied all the demands which consumers are now making on liquid cleaning preparations for hard surfaces.

According to published German application 28 40 463, a totally unexpected increase in the cleaning performance of liquid preparations for hard surfaces can be obtained by adding considerably smaller quantities of polyethylene glycols having a molecular weight of from 500,000 to 4,000,000 instead of the known additions of soil-suspending compounds.

According to published German application 29 13 049, equally favorable cleaning results can be obtained, even without any anionic surfactants, by using water-soluble, nonionic, weakly anionic or cationic polymers from the group of polyethylene glycols, polyvinyl alcohols, polyvinyl pyrrolidones, cellulose ethers, polysaccharides, proteins, and polyacrylamides having average molecular weights of 5,000 to 10,000,000 and preferably of 20,000 to 2,000,000, or mixtures of these polymers, instead of anionic surfactants.

DESCRIPTION OF THE INVENTION

Other than in the operating examples, or where otherwise indicated, all numbers expressing quantities of ingredients or reaction conditions used herein are to be understood as modified in all instances by the term "about".

It has now been found that both the cleaning power (CP) and the soil suspending power of liquid cleaning preparations for hard surfaces based on surfactants, cleaning enhancers, optionally builders and other standard ingredients of such preparations, can be increased to a surprisingly high degree if the cleaning preparations contain a mixture of polyacrylamides and highly polyethoxylated monofunctional or polyfunctional alkanols as the cleaning enhancers.

The liquid cleaning preparations of the invention contain:

(a) 0.5 to 40% by weight, preferably 5 to 20% by weight, of a surfactant or a surfactant mixture;

(b) 0.01 to 1% by weight, preferably 0.05 to 0.5% by weight, of cleaning enhancers;

(c) 0 to 6% by weight, preferably 1.0 to 6% by weight, of at least one organic and/or inorganic builder;

and up to a total of 100% by weight, based on the total weight, of water, and, optionally, one or more of solubilizers (solvents, hydrotropes), preservatives, antimicrobial agents, viscosity regulators, pH regulators, perfumes and dyes.

For component a), any known surfactant of the type typically used in cleaning preparations for hard surfaces as well as mixtures of such surfactants can be employed herein. These surfactants are, in general, surfactants containing at least one hydrophobic organic radical and a water-solubilizing anionic, nonionic, or cationic radical in the molecule. The hydrophobic radical is generally an aliphatic hydrocarbon radical containing 8 to 26, preferably 10 to 22, and more preferably 12 to 18 carbon atoms or an alkyl aromatic radical containing 6 to 18 and preferably 8 to 16 aliphatic carbon atoms. With respect to surfactant mixtures, the well-known incompatibility of many anionic and cationic surfactants with one another should of course be considered.

It is preferred to use nonionic surfactants and synthetic anionic surfactants, soaps, and mixtures thereof. Particularly preferred are surfactant combinations of nonionic surfactants of the ethoxylated alkanediol, alkanol, alkenol, and alkylphenol type and synthetic anionic surfactants from the group of sulfonate and sulfate surfactants. A soap may be present as a further component.

Nonionic surfactants include adducts of 4 to 40 moles, preferably 4 to 20 moles, of ethylene oxide or ethylene oxide and propylene oxide with 1 mole of fatty alcohols (preferably terminal or vicinal internal alkanediols), alkylphenols, fatty acids, fatty amines, fatty acid amides, or alkanesulfonamides. Adducts such as these include the adducts of 5 to 16 moles of ethylene oxide or ethylene oxide and propylene oxide with coconut or tallow fatty alcohols, with oleyl alcohol, or with secondary alcohols containing 8 to 18 and preferably 12 to 18 carbon atoms, and with mono- or dialkylphenols containing 6 to 14 carbon atoms in the alkyl radicals. The adducts of ethylene oxide with aliphatic vicinal terminal or internal alkanediols having a linear $C_{10}$-$C_{20}$ alkyl chain, which are known from U.S. 4,175,062, are of particular importance. In addition to these water-soluble nonionics, water-insoluble or substantially water-insoluble polyglycol ethers containing 1 to 4 ethylene glycol ether residues in the molecule can also be employed herein, particularly if they are used together with other water-soluble, nonionic or anionic surfactants.

Other suitable nonionic surfactants are the water-soluble adducts - containing 20 to 250 ethylene glycol ether groups and 10 to 100 propylene glycol ether groups - of ethylene oxide with propylene oxide, alkylenediamine polypropylene glycol, and alkyl polypropylene glycols containing 1 to 10 carbon atoms in the alkyl chain, in which the polypropylene glycol chain acts as the hydrophobic radical.

Nonionic surfactants of the amine oxide type can also be employed herein. Typical representatives include the compounds N-dodecyl-N,N-dimethylamine oxide, N-tetradecyl-N,N-dihydroxyethylamine oxide, and N-hexadecyl-N,N-bis-(2,3-dihydroxypropyl)amine oxide. Alkyl glucosides containing 10 to 18, preferably 12 to 14, carbona toms in the alkyl radical and 1 to 10, preferably 1 to 2, glucose units in the molecule can also be used as nonionic surfactants.

Synthetic anionic surfactants of the sulfonate type include alkyl benzenesulfonates ($C_9$-$C_{15}$ alkyl), mixtures of alkene and hydroxyalkane sulfonates and/or disulfonates, of the type obtained for example from monoolefins containing a terminal or internal double bond by sulfonation with gaseous sulfur trioxide and subsequent alkaline or acidic hydrolysis of the sulfonation group. Also suitable are alkane sulfonates obtained from alkanes by sulfochlorination sulfoxidation and subsequent hydrolysis or neutralization or by addition of bisulfites onto olefins. Other examples of surfactants of the sulfonate type include the esters of $\alpha$-sulfofatty acids, for example the $\alpha$-sulfonic acids of hydrogenated methyl or ethyl esters of coconut, palm kernel, or tallow fatty acid.

Synthetic anionic surfactants of the sulfate type include the sulfuric acid monoesters of primary alcohols (for example of coconut fatty alcohols, tallow fatty alcohols, or oleyl alcohol) and those of secondary alcohols. Also useful herein are sulfated fatty acid alkanolamides, fatty acid monoglycerides, or reaction products of 1 to 4 moles of ethylene oxide with primary or secondary fatty alcohols or alkylphenols.

Other synthetic anionic surfactants include the fatty acid esters or amides of hydroxy- or aminocarboxylic acids or -sulfonic acids, such as for example fatty acid sarcosides, glycolates, lactates, taurides, or isethionates.

Other anionic surfactants include soaps of natural or synthetic, preferably saturated, fatty acids, optionally of resinic or naphthenic acids.

All the above-disclosed anionic surfactants can be used in the form of their alkali metal, alkaline earth metal, and ammonium salts, and in the form of soluble salts of organic bases, such as mono-, di- or triethanolamine. The sodium salts are preferred for reasons of cost.

Where cationic surfactants are used, they contain at least one hydrophobic group and at least one basic, water-solubilizing group optionally present as a salt. The hydrophobic group is an aliphatic or cycloaliphatic hydrocarbon group, preferably containing 10 to 22 carbon atoms, or an alkyl- or cycloalkyl-aromatic group preferably containing 8 to 16 aliphatic carbon atoms. Basic groups include, preferably, basic nitrogen atoms which can also be repeatedly present in a surfactant molecule; e.g. preferably quaternary ammonium compounds, such as for example N-dodecyl-N,N,N,-trimethylammonium methosulfate, N-hexadecyl- or N-octadecyl-N,N,N,-trimethylammonium chloride, N,N-dicoconut alkyl-N,N-dimethyl ammonium chloride, N-coconut alkyl-N,N,-dimethyl-N-benzyl-ammonium chloride, N-dodecyl-N,N,-dimethyl-N-benzylammonium bromide, the reaction product of 1 mole of tallow alkylamine with 10 moles of ethylene oxide, N-dodecyl-N,N',N'-trimethyl-1,3-diaminopropane, N-hexadecylpyridinium chloride.

The nitrogen compounds disclosed above can also be replaced by corresponding compounds containing a quaternary phosphorus atom or a tertiary sulfur atom.

Component b) is a mixture of i) at least one polyacrylamide and ii) at least one highly polyethoxylated monofunctional or polyfunctional alkanol, in a ratio by weight of i) to ii) of 1 : 3 to 3 : 1, preferably 1 : 2 to 2 : 1.

The polyacrylamides are polymers and copolymers of acrylamide containing the group —$CH_2$—CH-($CONH_2$)— and having molecular weights of 300,000 to 15,000,000 and preferably of 2,000,000 to 12,000,000. They are marketed, inter alia, by the companies Dow (Separan ® MG 205; Separan ®NP 10), Stockhausen )Praeston ®2850; Praestol ® 2935/73; Praestol ® 114/73), BASF (Sedipur ®AF 200; Sedipur ® AF 400, Sedipur ®NF 100), and Henkel (P3-ferrocryl ®8720; P3-ferrocryl ®8721; P3-ferrocryl ®8723; P3-ferrocryl ®8740). When the polyacrylamide is a copolymer, one or more other monomers are present in a molar quantity up to about 50 mole% thereof. Such other monomers include acrylic acid, methacrylic acid, $C_1$-$C_4$ alkyl esters of the foregoing, methacrylamide, ethylene, propylene, isobutylene, vinyl acetate, and styrene.

The highly polyethoxyated monofunctional or polyfunctional, preferably monofunctional or difunctional, alkanols are adducts of 30 to 150 moles, preferably 40 to 90 moles, of ethylene oxide with terminal, optionally also internal, alkanols containing 12 to 22 carbon atoms, preferably 14 to 20 carbon atoms in the molecule, such as stearyl alcohol or 12-hydroxystearyl alcohol.

Component (c) can be one or more completely alkaline-reacting inorganic or organic compounds, more especially inorganic or organic complexing agents preferably present in the form of their alkali metal or amine salts, more especially their potassium salts, as builders for the liquid cleaning preparations of the invention.

Suitable inorganic complexing builders include the alkaline-reacting polyphosphates, more especially the tripolyphosphates and the pyrophosphates. They can be completely or partly replaced by organic complexing agents. Other inorganic builders which can be used in accordance with the invention include alkali metal dicarbonates, carbonates, borates, silicates, or orthophosphates. In the context of the invention, inorganic builders also include the alkali metal hydroxides, of which potassium hydroxide is preferably used.

Organic complexing agents which can be of the aminopolycarboxylic acid type include, inter alia, nitrilotriacetic acid, ethylenediaminetetraacetic acid, N-hydroxyethyl ethylenediamine triacetic acid, and polyalkylene polyamine-N-polycarboxylic acids. Examples of di- and polyphosphonic acids are methylenediphosphonic acid, 1-hydroxyethane-1,1-diphosphonic acid, propane-1,2,3,-triphosphonic acid, butane-1,2,3,4-tetraphosphonic acid, polyvinylphosphonic acid, copolymers of vinylphosphonic acid and acrylic acid, ethane-1,2-dicarboxy-1,2-dihydroxydiphosphonic acid, ethane-1,2-dicarboxy-1,2-dihydroxydiphosphonic acid, phosphonosuccinic acid, 1-aminoethane-1,1-diphosphonic acid, aminotri-(methylenephosphonic acid), methylamino- or ethylamino-di-(methylenephosphonic acid) and ethylenediamine-tetra-(methylenephosphonic acid).

Various, generally N- or P-free polycarboxylic acids can also be used as builders, such acids often, although not always, being polymers containing carboxyl groups. Many of these polycarboxylic acids are capable of complexing calcium. They include, for example, citric acid, tartaric acid, gluconic acid, benzenehexacarboxylic acid, tetrahydrofuran tetracarboxylic acid, etc. and mixtures thereof.

Because domestic cleaning preparations are generally made almost neutral or mildly alkaline, i.e. aqueous solutions thereof have a pH value of 7.0 to 10.5, preferably 7.5 to 9.5, for in-use concentrations of 2 to 20, preferably 5 to 15 g/l water or aqueous solution, an addition of acidic or alkaline components may be necessary in order to regulate the pH value within the above range.

Suitable acidic substances include standard inorganic or organic acids or acidic salts such as for example hydrochloric acid, sulfuric acid, alkali metal bisulfates, aminosulfonic acid, phosphoric acid, or other acids of phosphorus, more especially the anhydrous acids of phosphorus or acidic salts thereof or acidreacting solid compounds with urea or other lower carboxylic acid amides, partial amides of phosphorus acids, or anhydrous phosphoric acid, adipic acid, glutaric acid, succinic acid, citric acid, tartaric acid, lactic acid and the like, which in some instances also have complexing properties.

Where the content of alkaline builders is not sufficient to regulate the pH value, alkaline-acting organic or inorganic compounds can be added, such as alkanolamines, namely mono-, di- or triethanolamine, or ammonia.

In addition, from 0 to 10 % by weight, preferably from 0,5% to 5% by weight of known solubilizers can be added, such as water-soluble organic solvents, e.g. low molecular weight aliphatic $C_1$-$C_4$ alcohols, and/or so-called hydrotropes of the lower alkylarylsulfonate type, for example toluene, xylene or cumene sulfonate. They may also be present in the form of their sodium and/or potassium and/or alkylamino salts. Other solubilizers that can be used herein include water-soluble organic solvents, particularly those having boiling points above 75° C., such as for example the ethers of polyhydric alcohols or the partial ethers of polyhydric alcohols. Solubilizers such as these include, for example, di- or triethylene glycol polyglycerols, and the partial ethers of ethylene glycol, propylene glycol, butylene glycol or glycerol with aliphatic monohydric alcohols containing 1 to 4 carbon atoms in the molecule.

Water-soluble or water-emulsifiable organic solvents that can be employed herein include ketones, such as acetone, methyl ethyl ketone; aliphatic, cycloaliphatic, aromatic and chlorinated hydrocarbons; and various terpene alcohols either as individual substances or in the form of mixtures. Terpene alcohols have a perfuming effect.

To regulate the viscosity, it may be necessary or desirable to add from 0 to 5 %, preferably from 0,2 to 3 % by weight of a higher polyglycol ether having a molecular weight of up to about 600, or polyglycerol. In addition, it is advisable to add sodium chloride and/or urea to regulate the viscosity.

In addition, the claimed cleaning preparations can optionally contain small quantities, e.g. from 0 to 5 % by weight of one or more of dyes, perfumes, preservatives, and antimicrobial agents. Antimicrobial agents that can be used in the present cleaning compositions include compounds of the type which are stable and active therein. Such compounds include phenolic compounds of the halogenated phenol type containing 1 to 5 halogen substituents, more especially chlorinated phenols; alkyl, cycloalkyl, aralkyl and phenyl phenols containing 1 to 12 carbon atoms in the alkyl radicals and 1 to 4 halogen substituents, more especially chlorine and bromine, in the molecule; alkylene bisphenols, more especially derivatives substituted by 2 to 6 halogen atoms and, optionally, lower alkyl or trifluoromethyl groups and containing a $C_1$-$C_{10}$ alkylene bridge member; hydroxybenzoic acids or esters and amides thereof, more especially anilides, which can be substituted in the benzoic acid and/or aniline portion, more especially by 2 or 3 halogen atoms and/or trifluoromethyl groups; orthophenoxy phenols which may be substituted by 1 to 7 and preferably by 2 to 5 halogen atoms and/or by lower alkyl, hydroxyl, cyano, methoxycarbonyl, or carboxyl group. Particularly preferred antimicrobial agents of the phenyl type include O-phenylphenol, 2-phenylphenol, 2-hydroxy-2',4,4'-trichlorodiphenyl ether, 3,4',5-tribromosalicylanilide, and 3,3',5,5',6,6'-hexachloro-2,2'-dihydroxydiphenyl methane.

Other antimicrobial agents include the lower $C_3$-$C_5$ alcohols or diols substituted both by bromine and by the nitro group, such as for example the compounds 2-bromo-2-nitropropane-1,3-diol,1-bromo-1-nitro-3,3,3-trichloropropanol, and 2,2-bromo-2-nitro-1-butanol.

In addition, bis-diguanides such as, for example 1,6-bis-(p-chlorophenyldiguanido)-hexane in the form of the hydrochloride, acetate or gluconate, and N,N'-disubstituted 2-thionetetrahydro-1,3,5-thiadizines such as, for example, 3,5-dimethyl-, 3,5-diallyl-, 3-benzyl-5-methyl- and, in particular, 3-benzyl-5-carboxymethyl tetrahydro-1,3,5-thiadiazine, can also be used herein as antimicrobial agents.

In addition, it may be of advantage for certain applications to also add other antimicrobial agents, for example of the quaternary ammonium compound type, for example a benzylalkyl dimethylammonium chloride.

The invention will be illustrated but not limited by the following examples.

TESTS

The following tests were carried out to demonstrate the surprising cleaning-enhancing effect of the combination of the claimed compounds:

1. Testing of the cleaning power on fatty soil

The formulation to be tested for its cleaning power was applied to an artificially soiled white PVC plastic surface. A mixture of carbon black, machine oil, a triglyceride of saturated fatty acids, and low-melting aliphatic hydrocarbons was used as the artificial soil.

The 26 x 4.0 cm test area was uniformly coated with 0.3 and 0.6 g (diluted and undiluted product) of the artificial soil and kept at room temperature for 1 hour before the beginning of the test. A plastic sponge was then soaked with 10 ml (6 ml in the case of the undiluted product) of the cleaning solution to be tested and moved back and forth over the test surface by machine, the sponge covering both the soiled middle area and also the unsoiled peripheral zones. After 10 wiping movements under a precisely defined contact pressure of 2 kp, the cleaned test surface was rinsed with 400 ml tapwater and the loosened soil thus removed. The cleaning power, i.e. the whiteness of the plastic surface thus cleaned, was measured with a Dr. B. Lange LF 90 photoelectric reflection meter, the whiteness of the originally soiled part of the test surface being used to determine the cleaning power. The cleaned, white PVC plastic surface was used as the whiteness standard. Since the deflection of the measuring instrument was adjusted to 100% in the measurement of the cleaned surface and to 0% in the measurement of the soiled surface, the values read off on the cleaned plastic surfaces could be regarded as "percentage cleaning power" (% CP). The delta-CP values indicated (increase in cleaning power) are the average values of 4 measurements.

EXAMPLE 1

(a) To a commercial all-purpose cleaning preparation for hard surfaces having the following composition in percent by weight:

0.5% sodium-$C_{12}$-$C_{14}$-alkyl benzenesulfonate
2.0% nonylphenol reacted with 9 moles ethylene oxide
0.8% ethylene diamine tetraacetate
2.0% butyl glycol
balance to 100%: demineralized water was added 0.5% by weight of a mixture of 12-hydroxystearyl alcohol, reacted with 73 moles ethylene oxide (=EO), and polyacrylamide having a molecular weight of $5 \times 10^6$ (ratio by weight 2:1). 6 ml of this undiluted product produced an increase in cleaning power of delta-CP =34%.

(b) A delta-CP of 43% was obtained under the same conditions as in (a), but with removal of the anionic surfactant in accordane with the teaching of published German application 29 13 049.

(c) When the cleaning enhancer mixture according to the invention was replaced by one within the disclosure of German application 29 13 049, namely by a polyethylene glycol having a molecular weight of 600,000 (Polyox ® WSR 205, a product of Union Carbide Corporation), and the polyacrylamide used in (a) in a ratio by weight of 2:1, the delta-CP was only 30%.

EXAMPLE 2

To a commercially available, builderless all-purpose cleaning preparation having the following composition:

2% $C_{12}$-$C_{14}$ alkanediol . 10 EO
8% sodium-$C_{12}$-$C_{14}$-alkyl benzenesulfonate
balance to 100%: demineralized water was added 0.2% of the cleaning enhancer mixture described in Example 1a). The mixture was again applied in undiluted form. The delta-CP was 36%. When the same quantity of a cleaning enhancer mixture of Example 1(c) was added, the delta-CP was only 26%.

The following Table shows examples of mixtures of various, predominantly anionic and nonionic surfactants and various, if any, builders to which considerably smaller quantities of polymer mixtures according to the invention were added than in Example 1 and 2 and their cleaning effect determined at 25° C./16° Gh. The delta-CP values show that, even then, significant improvements were obtained. (Dilute cleaning mixtures (10 g product per liter tapwater at 25° C./16° Gh) were used in Examples 3 to 7 while undiluted cleaning mixtures (6 g product) were used in Example 8 to 10).

TABLE

Cleaning-enhancing effect of the polymer combination

| Example No. | Surfactant content (g/l) (in use) | Polymer (g/l) (in use) | Ratio by weight of mixture | Builder (g/l) (in use) | Delta-CP |
|---|---|---|---|---|---|
| 1 | $C_{12}$—$C_{14}$—alkylbenzenesulfonate (0.8)/ $C_{12}$—$C_{14}$ alkanediol :10 EO (0.2) | 12-hydroxystearyl alcohol·73 EO/ polyacrylamide (0.1) | 1:0 | pentasodium triphosphate (0.3) | −7 |
| | | | 4:1 | | −5 |
| | | | 2:1 | | +6 |
| | | | 1:1 | | −6 |
| | | | 0:1 | | −13 |
| 2 | $C_{12}$—$C_{14}$—alkylbenzenesulfonate (0.8)/ $C_{12}$—$C_{14}$ alkanediol ·10 EO (0.2) | 12-hydroxystearyl alcohol ·73 EO/ polyacrylamide (0.03) | 1:0 | pentasodium triphosphate (0.3) | +7 |
| | | | 4:1 | | +9 |
| | | | 2:1 | | +12 |
| | | | 1:1 | | +3 |
| | | | 0:1 | | +8 |
| 3 | $C_{12}$—$C_{14}$—alkylbenzenesulfonate (0.8)/ $C_{12}$—$C_{14}$—alkanediol ·10 EO (0.2) | 12-hydroxystearyl alcohol·73 EO/ polyacrylamide (0.03) | 1:0 | none | +1 |
| | | | 2:1 | | +10 |
| | | | 1:1 | | +2 |
| | | | 0:1 | | +5 |
| 4 | $C_{12}$—$C_{14}$—alkylbenzenesulfonate (0.8)/ $C_{12}$—$C_{14}$ alkanediol ·10 EO (0.2) | 12-hydroxystearyl alcohol·73 EO/ polyacrylamide (0.01) | 1:0 | sodium citrate (0.3) | +2 |
| | | | 2:1 | | +10 |
| | | | 1:1 | | +7 |
| | | | 0:1 | | 0 |
| 5 | $C_{12}$—$C_{14}$—alkylbenzenesulfonate (0.8)/ $C_{12}$—$C_{14}$ alkanediol ·10 EO (0.2) | tallow alcohol·80 EO/polyacrylamide (0.03) | 1:0 | pentasodium triphosphate (0.03) | +15 |
| | | | 2:1 | | +16 |
| | | | 1:1 | | +19 |
| | | | 0:1 | | +8 |
| 6 | $C_8$—$C_{10}$ alkyl glucoside containing 1.8 GU (0.8)/$C_{12}$—$C_{14}$ alkanediol·10 EO (0.2) | 12-hydroxystearyl alcohol·73 EO/ polyacrylamide (0.03) | 1:0 | pentasodium triphosphate (0.3) | +0 |
| | | | 2:1 | | +4 |
| | | | 0:1 | | +2 |
| 7 | $C_{13}$—$C_{15}$ sec.-alkane sulfonate | 12-hydroxysteryl alcohol·73 EO/ | 1:0 | pentasodium triphosphate | +8 |
| | | | 2:1 | | +6 |

TABLE-continued

| Example No. | Surfactant content (g/l) (in use) | Polymer (g/l) (in use) | Ratio by weight of mixture | Builder (g/l) (in use) | Delta-CP |
|---|---|---|---|---|---|
| | Cleaning-enhancing effect of the polymer combination | | | | |
| | (0.8)/$C_{12}$—$C_{14}$ alkanediol·10 EO (0.2) | polyacrylamide (0.03) | 0:1 | (0.3) | +9 |
| 8 | $C_{12}$—$C_{14}$—alkylsulfate (60)/coconut fatty acid monoethanolamide (10) | 12-hydroxystearyl alcohol·73 EO/ polyacrylamide (3) | 2:1 | Na gluconate (20) | +26 (undiluted product) |
| 9 | $C_{12}$—$C_{14}$ alkylenesulfonate (80)/ $C_{12}$—$C_{14}$ alkanediol ·10 EO (20) | 12-hydroxystearyl alcohol·73 EO/ polyacrylamide (3) | 2:1 | Na gluconate (20) | +28 (undiluted product) |
| 10 | $C_{12}$—$C_{14}$ fatty alcohol·5 EO·4 PO (50)/$C_{12}$—$C_{14}$ alkyldimethyl benzylammonium chloride (20) | 12-hydroxystearyl alcohol·73 EO/ polyacrylamide (3) | 2:1 | ethylenediamine tetraacetic acid (24) | +9 (undiluted product) |

$^{x}$EO = adduct of x moles ethylene oxide with basic substance
$^{x}$PO = adduct of x moles propylene oxide with basic substance

We claim:

1. An aqueous cleaning composition comprising:
(a) from about 0.5 to about 40% by weight of at least one surfactant;
(b) from about 0.01 to about 1% by weight of a mixture of
(i) at least one polyacrylamide, and
(ii) at least one polyethoxylated monofunctional or polyfunctional alkanol; and
(c) from 0 to about 6% by weight of at least one builder:
wherein the at least one polyacrylamide component (b)(i) is a homopolymer or copolymer or acrylamide having a molecular weight of from about 300,000 to about 15,000,000; component (b)(ii) is at least one adduct of 30 to 150 moles of ethylene oxide with a terminal alkanol containing from 12 to 22 carbon atoms; the weight ratio of component b)i) to component (b)(ii) is from about 1 : 3 to about 3 : 1; and the composition when diluted to from about 2 to about 20 g/l in water has a pH in the range of from 7.0 to about 10.5; and wherein when the at least one polyacrylamide component (b)(i) is a copolymer of acrylamide, one or more monomers other than acryalmide is present in a molar quantity of up to about 50 mole % thereof and which monomers selected from the group consisting of acrylic acid, methacrylic acid, $C_1$-$C_4$ alkyl esters of the foregoing, methacrylamide, ethylene, propylene, isobutylene, vinyl acetate, and styrene.

2. The composition of claim 1 wherein component (b)(i) has a molecular weight of from about 2,000,000 to about 12,000,000.

3. The composition of claim 1 wherein the weight ratio of component (b)(i) to component (b)(ii) is from about 1 : 2 to about 2 : 1.

4. The composition of claim 1 wherein component (b)(i) is a polymer of acrylamide.

5. The composition of claim 1 wherein component (a) is present in from about 5 to about 20% by weight.

6. The composition of claim 1 wherein component (b) is present in from about 0.05 to about 0.5% by weight.

7. The composition of claim 1 wherein component (c) is present in from about 1.0 to about 6% by weight.

8. The composition of claim 1 wherein component (a) is present in from about 5 to about 20% by weight, component (b) is present in from about 0.05 to about 0.5% by weight, and component (c) is present in from about 1.0 to about 6% by weight.

9. The composition of claim 1 wherein component (b)(ii) is an adduct of from 40 to 90 moles of ethylene oxide with a terminal alkanol containing from 14 to 20 carbon atoms.

10. The composition of claim 9 wherein the terminal alkanol is a difunctional alkanol.

11. The composition of claim 9 wherein the terminal alkanol is stearyl alcohol or 12-hydroxystearyl alcohol.

12. An aqueous cleaning composition comprising
(a) from about 5 to about 20% by weight of at least one surfactant;
(b) from about 0.05 to about 0.5% by weight of a mixture of
(i) at least one polyacrylamide, and
(ii) at least one polyethoxylated monofunctional or difunctional alkanol; and
(c) from about 1.0 to about 6% by weight of at least one builder;
wherein the at least one polyacrylamide component (b)(i) is a homopolymer or copolymer of acrylamide having a molecular weight of from about 2,000,000 to about 12,000,000; component b)ii) is at least one adduct of 40 to 90 moles of ethylene oxide with a terminal alkanol containing from 14 to 20 carbon atoms; the weight ratio of component (b)(i) to component (b)(ii) is from about 1 : 2 to about 2: 1; and the composition when diluted to from about 2 to about 20 g/l in water has a pH in the range of from 7.5 to about 9.5; and wherein when the at least one polyacrylamide component (b)(i) is a copolymer of acrylamide, one or more monomers other than acrylamide is present in a molar quantity of up to about 50 mole % thereof and which monomers selected from the group consisting of acrylic acid, methacrylic acid, $C_1$-$C_4$ alkyl esters of the foregoing, methacrylamide, ethylene, propylene, isobutylene, vinyl acetate, and styrene.

13. An aqueous cleaning composition comprising the composition of claim 1 in a quantity of from about 2 to about 20 g/l in water.

14. An aqueous cleaning composition comprising the composition of claim 12 in quantity of from about 2 to about 20 g/l in water.

15. The aqueous cleaning composition of claim 13 wherein the composition of claim 1 is present in from about 5 to 15 g/l in water.

16. The aqueous cleaning composition of claim 14 wherein the composition of claim 12 is present in from about 5 to 15 g/l in water.

17. A method for cleaning hard surfaces comprising contacting a hard surface with a cleaning-effective quantity of the composition of claim 1 or a diluted solution thereof.

18. The aqueous cleaning composition of claim 1 wherein component (a) is at least one surfactant that contains at least one hydrophobic organic radical and a water-solubilizing anionic, nonionic, or cationic radical therein.

19. The aqueous cleaning composition of claim 18 wherein the at least one hydrophobic organic radical is an aliphatic hydrocarbon radical containing from 8 to 26 carbon atoms.

20. The aqueous cleaning composition of claim 19 wherein the aliphatic hydrocarbon radical contains from 10 to 22 carbon atoms.

21. The aqueous cleaning composition of claim 20 wherein from 12 to 18 carbon atoms are present in the aliphatic hydrocarbon radical.

22. The aqueous cleaning composition of claim 18 wherein the at least one hydrophobic organic radical is an alkyl aromatic radical containing from 6 to 18 aliphatic carbon atoms.

23. The aqueous cleaning composition of claim 22 wherein the alkyl aromatic radical contains from 8 to 16 aliphatic carbon atoms.

24. The aqueous cleaning composition of claim 18 wherein component a) is one or more of a nonionic surfactant, a synthetic anionic surfactant, or a soap.

25. The aqueous cleaning composition of claim 18 wherein component (a) is at least one of an ethoxylated alkanediol, an ethoxylated alkanol, an ethoxylated alkenol, an ethoxylated alkylphenol, an anionic sulfonate surfactant, and an anionic sulfate surfactant.

26. The aqueous cleaning composition of claim 25 wherein component (a) also contains a soap.

27. The aqueous cleaning composition of claim 12 wherein component (a) is at least one surfactant that contains at least one hydrophobic organic radical and a water-solubilizing anionic, nonionic, or cationic radical therein.

28. The aqueous cleaning composition of claim 27 wherein the at least one hydrophobic organic radical is an aliphatic hydrocarbon radical containing from 8 to 26 carbon atoms.

29. The aqueous cleaning composition of claim 27 wherein the at least one hydrophobic organic radical is an alkyl aromatic radical containing from 6 to 18 aliphatic carbon atoms.

* * * * *